US005871200A

United States Patent [19]

Wallace et al.

[11] Patent Number: 5,871,200

[45] Date of Patent: Feb. 16, 1999

[54] WATER WELL RECHARGE THROTTLE VALVE

[75] Inventors: Glenn E. Wallace, Anaheim, Calif.; Mark H. Peterson, Las Vegas, Nev.

[73] Assignee: VoV Enterprises, Inc., Anaheim, Calif.

[21] Appl. No.: 871,652

[22] Filed: Jun. 9, 1997

[51] Int. Cl.[6] ..... F16K 31/122; F16K 47/00

[52] U.S. Cl. ..... 251/63; 166/320; 251/205; 251/324; 405/52; 405/80

[58] Field of Search ..... 251/62, 63, 205, 251/324, 325; 166/320; 405/36, 52, 80

[56] References Cited

U.S. PATENT DOCUMENTS

| | | | |
|---|---|---|---|
| 353,548 | 11/1886 | Franklin | 251/205 |
| 922,060 | 5/1909 | Stockdon | 251/205 |
| 1,799,373 | 4/1931 | Humason | 166/205 |
| 1,919,955 | 7/1933 | Leech et al. | 251/205 |
| 2,654,395 | 10/1953 | Kaye | 251/122 |
| 3,120,267 | 2/1964 | Bayless | 166/332 X |
| 3,220,693 | 11/1965 | Dickson | 251/122 |
| 3,497,004 | 2/1970 | Page, Jr. | 251/63 |
| 3,679,169 | 7/1972 | Bedo et al. | 251/122 |
| 3,761,053 | 9/1973 | Bedo et al. | 251/122 |
| 3,908,536 | 9/1975 | Bajcar | 251/325 |
| 3,937,247 | 2/1976 | Van Der Wal | 251/325 |
| 4,047,695 | 9/1977 | Cleveland et al. | 138/46 |
| 4,114,851 | 9/1978 | Shivak et al. | 251/122 |
| 4,134,454 | 1/1979 | Taylor | 166/320 |
| 4,280,569 | 7/1981 | Mount, II | 251/63 |
| 4,330,012 | 5/1982 | Chadwick | 251/63 |
| 4,377,177 | 3/1983 | Claycomb | 251/122 |
| 5,090,450 | 2/1992 | Pelech | 251/325 |
| 5,503,363 | 4/1996 | Wallace | 251/63 |
| 5,618,022 | 4/1997 | Wallace | 251/62 |

FOREIGN PATENT DOCUMENTS

| | | | |
|---|---|---|---|
| 282823 | 3/1952 | Switzerland | 251/63 |
| 952007 | 3/1964 | United Kingdom | 251/63 |

*Primary Examiner*—George L. Walton
*Attorney, Agent, or Firm*—Millen, White, Zelano, & Branigan, P.C.

[57] ABSTRACT

The VoSmart (a Variable Orifice/ Selective Monitored Artificial Recharge Throttle) Valve is a disclosed and the preferred embodiment of a hydraulically actuated flow control device that permits the calibrated throttling of water used in Artificial Storage and Recovery (ASR), Salt Water Barrier, Dedicated Recharge and Injection Wells to prevent the free cascading of water and thereby eliminate the entrainment of air which may cause air fouling, bio-fouling, and calcite formation with the resultant reduction in permeability of the aquifer. Wherein the VoSmart Valve includes a fixed tubular member which is selectively mounted in one of three ways: 1) to the lower end of the pump column, below the pump with a check valve/strainer mounted below the unit, a co-generation/recharge feature, 2) to the lower end of the pump column, and above the check valve and submersible pump and 3) To the lower end of the drop pipe, with a blind flange connected to the bottom end of the valve, a dedicated recharge well application. The inner member contains fixed flow control openings which an outer upwardly based flow regulating tubular member is axially moved with double acting hydraulic actuator to adjust the flow through the flow control openings. The axial position of the valve is controlled by a double acting hydraulic actuator built into the unit and completed through small stainless steel tubes to a hydraulic flow control valve and a hydraulic pump.

7 Claims, 4 Drawing Sheets

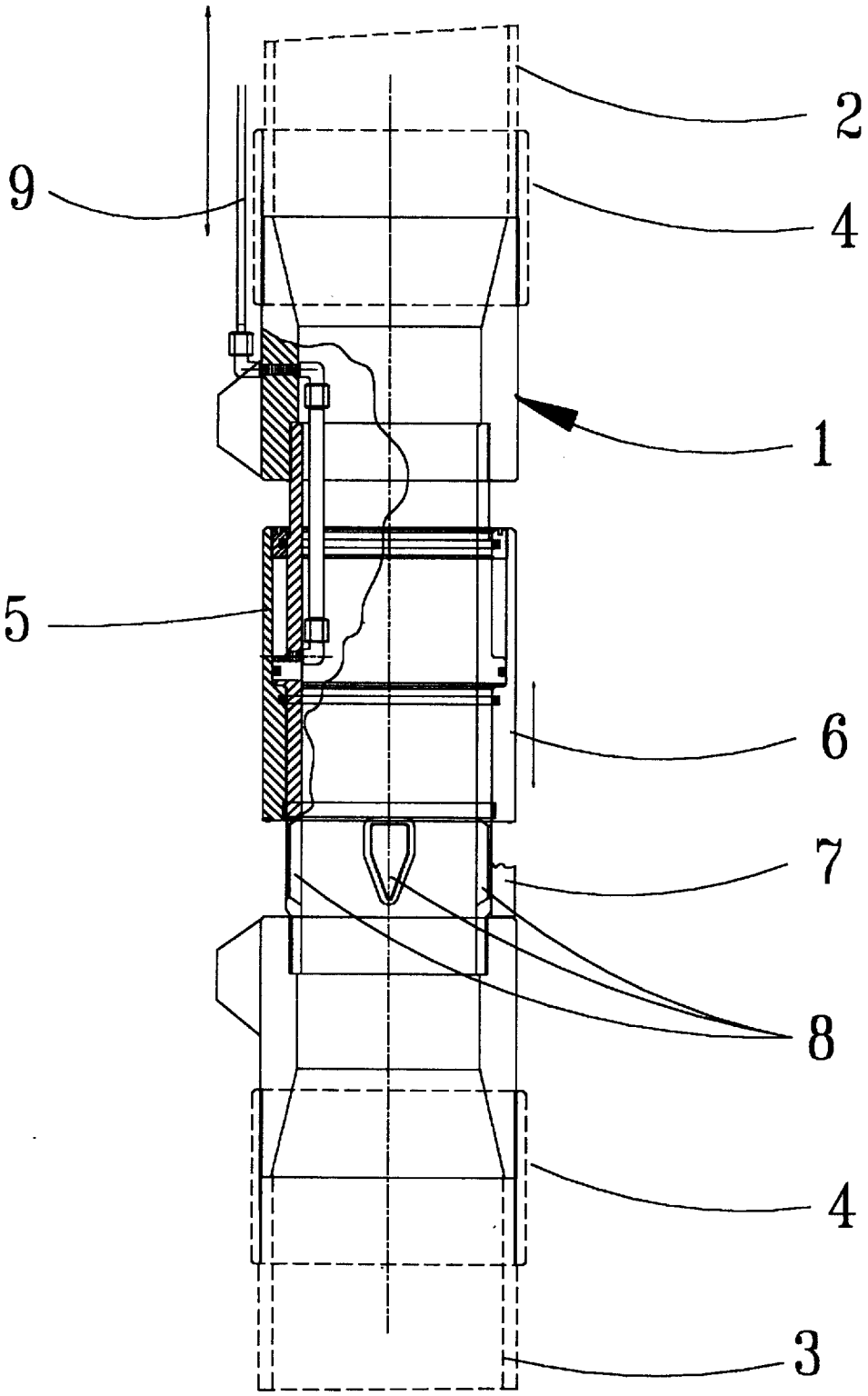
FIGURE #1

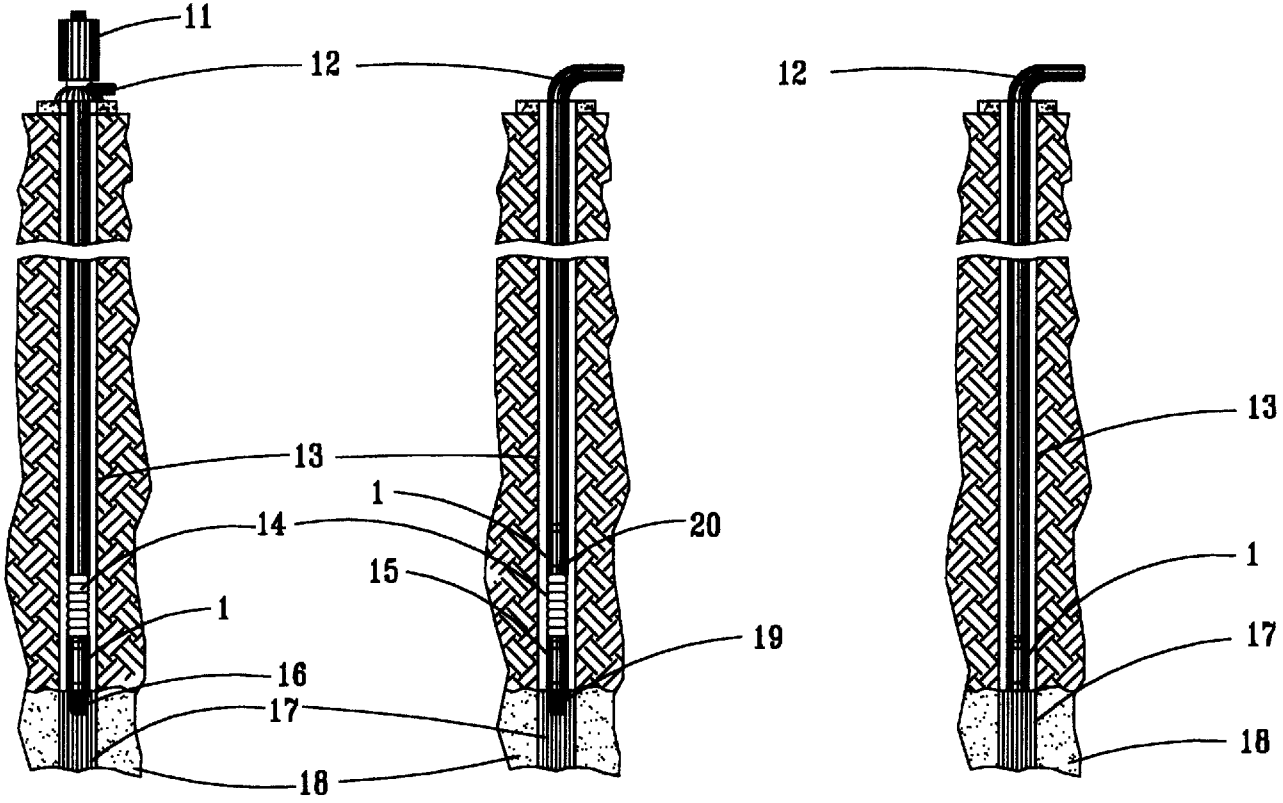
FIGURE # 2
FIGURE #3
FIGURE #4

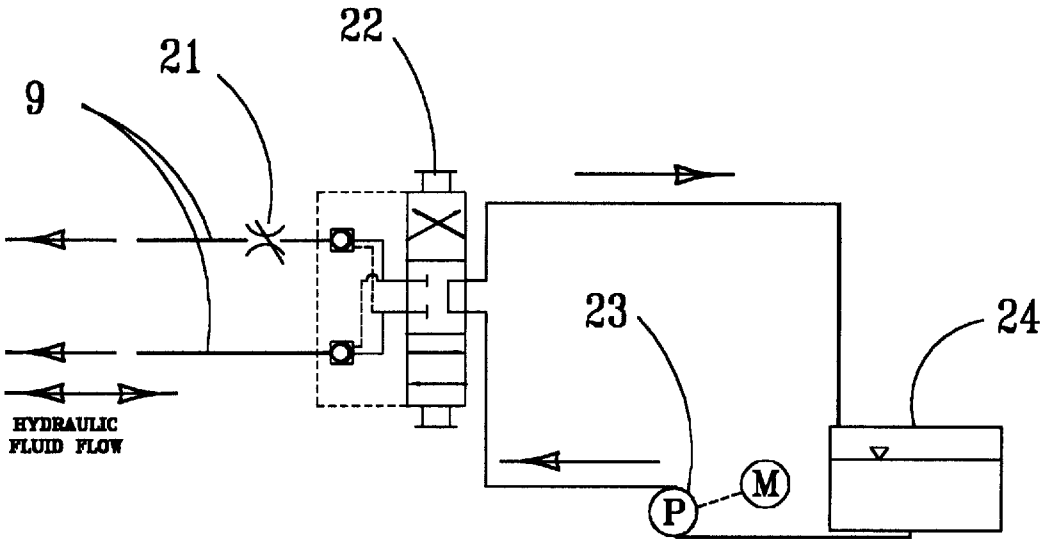
FIGURE #5

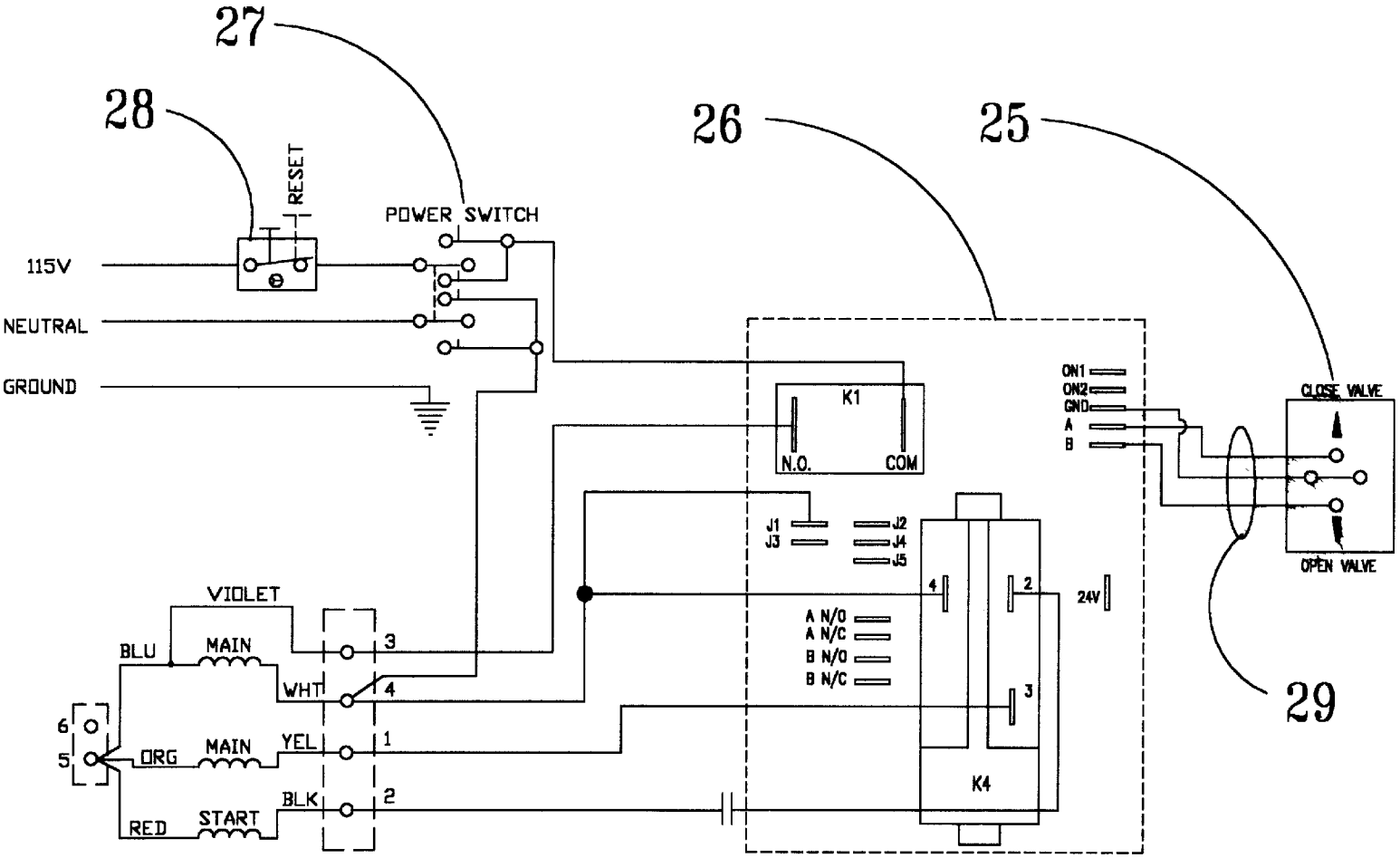
FIGURE #6

WATER WELL RECHARGE THROTTLE VALVE

BACKGROUND OF THE INVENTION

1. Field of the Invention

This invention is generally directed to flow control devices for use in water wells and in particularly to a downhole flow controller for use in recharge, injection and aquifer storage recovery wells wherein the VoSmart (a Variable Orifice Selective Monitored Artificial Recharge Throttle) Valve continuously regulates the flow of water during periods of recharging. During recharging the water in the column or drop pipe is controlled to prevent air from being entrained or trapped in the fluid flow and carried into the aquifer. Entrained air can adversely effect the recharge efforts, through air-fouling, bio-fouling and calcite formation, by blocking the flow of water into the aquifer.

2. History of the Invention.

Many Water Districts and Communities have realized the need and value of maintaining the water level and storage capacity of the aquifers that provide their drinking water. Further due to the high demand and to the variability of supply and demand, it is logical that an adequate reserve capacity of the water storage facilities be maintained to provide for extended peak demands, droughts and explosive growths in new customers. Reserve storage capacity to provide for these events in capital facilities is prohibitively expensive to construct and more difficult to justify, therefor capital facilities typically lag behind demand.

In an effort to reduce these capital facility costs, Water Resource Engineers have become interested in the concept of replacing or storing large volumes (banking) of treated water in aquifers during periods of the year when both water and facility capacity are available to supply water required to recharge aquifers. The concept replacing the water pumped from the aquifer or seasonal storage is called Aquifer Storage Recovery or ASR. This scenario is an alternative to conventional expansion of water supply, treatment, distribution and storage capital facilities is quite cost effective in areas where it is technically feasible. In general a well based system or one that is partially well based is a system that the wells can be used for both recharge and recovery. In recovery the water may require only disinfection. Recharge wells may be through existing wells or through dedicated recharge wells.

In addition to reduction in facilities expansion costs, other advantages favor recharge technology. In coastal areas reduced levels in aquifer water may permit the intrusion of salt water which can result in the destruction of the fresh water supply. In these areas, a mound of recharged fresh water is placed, through balanced flow control, in the aquifer forming a uniform curtain or barrier between the salt water and the fresh water, effectively preventing salt water intrusion. At times this volume of water can be used to meet seasonal peak demands.

Such storage and water resource techniques have proven extremely advantageous and cost effective in areas where declining ground water levels have reduced or left wells nearly non-productive.

An other application of this type of device is the use in ground water remediation. In areas where existing ground water supplies are threatened or have been contaminated flow control devices are effective in managing an effective program. Once the water is extracted and treated this type of flow control device is able to balance the flow in a series of recharge wells to provide a uniform curtain of water, placing the water in the aquifer evenly and uniformly.

Well recharging is also effective where substantial reserves are necessary to improve system reliability in the event of a catastrophic loss of a primary water supply or in communities where strategically located reserves are required to insure an adequate balance in system flows during peak demand.

Although there are obvious benefits to obtained from recharging existing production water wells or in constructing new water storage recovery wells, in many applications problems have been encountered with air entrapment in the recharge water causing air binding of the aquifer. Air binding effectively decreases the permeability of the aquifer thereby decreasing the effectiveness of the recharging operations. Such air entrapment most is most frequently encountered in areas or localities where one or more of three conditions exist. These conditions may be encountered when; 1. the recharge water must drop a considerable distance from the well head to the static water level; 2. When the recharge flow is relatively low and; 3. Where the specific capacity of the well is relatively high. The foregoing conditions have resulted in the cascading of water in the column or drop pipe thereby entrapping large quantities of air which is carried into the well and outwardly into the aquifer. The entrapped air can effectively plug or seal the aquifer, a condition known as air fouling, resulting in substantially lower permeability and storage capacity. The answer to mitigating this problem is to pump the well thereby restoring a portion of the lost capacity.

There have been flow control devices developed by the oil and gas industry, such controllers are not suitable for use in controlling cascading in recharge, injection or aquifer storage recovery wells. One alternative used to mitigate the air entrainment involves the use of multiple small injection tubes to place the water in the aquifer. Such alternative is possible in wells using large diameter well casing and well screens. This system is costly and generally not suitable for retrofitting existing wells.

SUMMARY OF THE INVENTION

This disclosure is directed to a downhole flow control device for continuously regulating the flow of water during recharge, injection or aquifer storage recovery. During recharge, the flow is controlled to prevent cascading water which would otherwise lead to air-fouling or aquifer plugging through air entrapment. The embodiment includes two concentric cylinders or tubular members, one of which has flow control ports, the other is connected to and selectively moved by the hydraulic actuator section, thereby setting the flow through the ports by varying their size.

The inner tubular member with the control ports is stationery and the outer tubular member is moved vertically by hydraulic pressure in the double acting hydraulic actuator section. The hydraulic actuator is controlled through 2 capillary tubes from the well head by a solenoid or manually operated 3 position 4 way control valve in series with a flow control valve. The hydraulic pressure is supplied by an electrically driven pump. Speed of operation is set by adjusting the hydraulic fluid flow control valve manually or automatically. The solenoid valve may be controlled locally or by a Supervisory Control and Data Acquisition (SCADA) system from a remote location.

The disclosure is connected in one of three ways: first by being installed below a vertical turbine pump and above a foot valve, a configuration that is set up for co-generation during recharge; second being installed above a submersible pump and check valve; and third being connected to the bottom end of the injection pipe with the disclosure closed at its lower end.

In dual purpose wells used for both water production and recharge (also known as aquifer storage and recovery, or ASR, wells), the disclosure is installed at the base of the pump column, just below the pump bowls and above the foot valve/strainer. This application is best suited for co-generation during recharge, the pump is rotated during recharge and the motor becomes a generator producing electricity. A second application is with the disclosure installed above a submersible pump and check valve. During recharge the pump and motor are stationary. In single purpose recharge or injection wells, the disclosure, with a closed lower end, is connected to the bottom of the drop pipe and set near the top of the well screen.

The primary objective of the disclosure is to provide downhole flow control for use with recharge, injection and aquifer storage recovery (ASR) wells wherein the flow of the recharge water is facilitated and controlled in order to eliminate a significant amount of air-fouling or well plugging through air binding form air entrapment.

Another objective of the disclosure to provide downhole flow control for recharge, injection and ASR wells which are designed to be incorporated within existing or new wells in order to reduce air entrainment which is normally associated with recharge operations.

It is also an objective of this disclosure to provide a simple, durable and cost effective flow control for regulating the flow hydraulically, while monitoring a flow measuring device (meter) which assures a desired well flow that can be adjusted to meet the specific static and operational pressures that are encountered or anticipated in a variety of environments.

It is a further objective of this disclosure to provide downhole flow control for preventing air binding in recharge, injection and ASR wells wherein minor adjustments to flow may be selectively regulated form the well head.

BRIEF DESCRIPTION OF THE DRAWINGS

FIG. 1 is a sectional view of a well recharge throttle valve according to the invention in an open position.

FIG. 2 is a sectional view through an ASR well illustrating the location of the well recharge throttle valve mounted below a vertical turbine pump column and above a foot valve in an installation used for co-generation with a vertical turbine pump.

FIG. 3 is a sectional view through an ASR well illustrating the location of the well recharge throttle valve above a submersible pump and check valve.

FIG. 4 is a sectional view through all injection well illustrating an installation well recharge throttle valve at the bottom of a drop pipe and near the top of a well screen.

FIG. 5 is a schematic drawing of a hydraulic control circuit used with the present invention.

FIG. 6 is a schematic drawing of a power unit and solenoid control valve used with the present invention.

DETAILED DESCRIPTION OF THE PREFERRED EMBODIMENT

Attention is first directed to FIG. 1, this illustrates the embodiment of this invention, A Variable Orifice Selective Monitored Artificial Recharge Throttle (VoSmart) Valve. FIGS. 2, 3 & 4 illustrates the various combinations of application for this embodiment. FIG. 5 schematic illustrates the hydraulic system used as a control apparatus and hydraulic fluid power. This device, the VoSmart Valve is operated under positive hydraulic pressure and is hydraulically locked when not being operated. In the event of loss of hydraulic fluid in one of the hydraulic lines the valve will remain locked in the last set position or fail safe position, in the event of loss of hydraulic fluid in both lines the valve will slowly close. The hydraulic fluid is propylene glycol or other fluid that is not an environmental hazard, in the event of loss of hydraulic fluid. The VoSmart Valve is generally identified by the number 1 and is configured as a pipe section having an upper end 20 and a lower end 21. To this end, the apparatus incorporates fluid lines 9 which deliver hydraulic fluid under pressure to the double acting hydraulic actuator portion 5 of the valve which moves the throttling portion 6, which is configured as a sleeve, over the "D" orifices 8 to control water flow through the orifices during the recharge operation. When the pump is operating, the valve 1 is in the closed position 7. When used in conjunction with a pump, the VoSmart Valve will have a flow inhibitor in the form of a check valve at the location 3 indicated in FIG. 1. In the dedicated recharge application of FIG. 4, the flow inhibitor is a blind flange installed at location 3.

As is seen in FIGS. 2–4, the recharge pipe 12 is connected to a source of pressurized water 22. As has been set forth in the "Background of the Invention," it is necessary to avoid cascading if one is to keep air out of the aquifer. Cascading is eliminated by keeping the recharge pipe full which is accomplished by adjusting the throttle portion 6 of the valve. The valve may be adjusted within the design range by observing a flow monitoring means or flow meter which is a part of the normal piping at the well head. The meter is also used to totalize and record the flow of water during pumping or recharge. The initial pumping rate and recharge rate is determined by a geologist at the time of drilling from pump tests and aquifer test data. To operate the VoSmart Valve, the hydraulic power unit is turned on 27, FIG. 6, and the switch operating the solenoid control valve 25 depressed in the close or open position, the hydraulic control valve 22 is shifted from the locked position by an electrical control 26 and hydraulic fluid is forced through the capillary lines 9, FIG. 5, 1, by the pump 23 , FIG. 5, taking fluid from the reservoir 24 to one of the capillary tubes 9, FIG. 5,1, with hydraulic fluid returning in the other capillary tube 9 to the hydraulic storage tank 24, FIG. 5, operate the Valve moving the throttling portion 6 to increase or decrease the size of the "D" ports 8. The speed of operation is set by adjusting the speed control valve 21, FIG. 5. Due to the wet environment that this valve operates in, the component parts of the valve 1, FIG. 1, are fabricated from highly corrosive resistant steel. The column pipe 2 and the check valve or blind flange 3 are made of materials normally used for column pipes, check valves and blind flanges.

I claim:

1. A down hole flow control in combination with a recharge pipe inserted in a recharge well for recharging aquifers with a stream of pressurized water, the flow control comprising:

a valve configured as a pipe section having an upper end for coupling the valve through the recharge pipe with a source of pressurized water; the valve further including an intermediate portion and a lower end for coupling with a flow inhibitor;

a plurality of outlet ports in the intermediate section, through which outlet ports the stream of pressurized water flows into the aquifer;

a sleeve over at least the intermediate section, the sleeve being moveable between a first position in which the sleeve covers the outlet ports to block the flow of water out of the outlet ports and a second position in which the sleeve at least partially opens the outlet ports to throttle water flow therefrom into the aquifer; and a double acting hydraulic actuator associated with the sleeve for moving the sleeve between the first and second positions to keep the recharge pipe filled with water by limiting the amount of water discharged from the recharge pipe, whereby air does not interfere with recharging the aquifer by becoming entrained in the stream of water due to voids therein as the stream of water moves down through the recharge pipe prior to entering the aquifer.

2. The down hole flow control of claim 1 wherein the double acting hydraulic actuator comprises a pair of hydraulic lines which apply pressure in a first direction to move the sleeve to cover the outlet ports and apply pressure in a second direction to uncover the outlet ports.

3. The down hole flow control of claim 2 wherein the hydraulic lines are connected to an above ground hydraulic controller, the hydraulic controller comprising a hydraulic pump and a directional valve with a flow rate control valve connecting the pump to the lines, the directional valve determining which direction the hydraulic fluid flows in the directional lines and thus whether the sleeve covers or uncovers the outlet ports, and the flow rate control valve controlling the speed at which the sleeve moves from the first position to the second position.

4. The down hole flow control of claim 3 wherein the outlet ports decrease in area in the direction of the second position.

5. The down hole flow control of claim 1 wherein the valve configured as a pipe section has a vertical down hole pump coupled to the upper end, which vertical down hole pump is connected to the recharge pipe that is in turn connected to a motor generator, the flow inhibitor being a check valve.

6. The down hole flow control of claim 1 wherein the valve configured as a pipe section is connected at the upper end thereof directly to the recharge pipe and connected at the lower end thereof to a vertical down hole pump, the vertical down hole pump having a foot valve at the other end thereof, the flow inhibitor being a check valve.

7. The down hole flow control of claim 1 wherein the valve configured as a pipe section is connected at the upper end thereof to the recharge pipe and wherein the flow inhibitor is a blind flange.

* * * * *